United States Patent [19]

Riddle

[11] Patent Number: 4,530,399

[45] Date of Patent: Jul. 23, 1985

[54] STOP DEVICE FOR WELL CONDUIT

[75] Inventor: Harry W. Riddle, San Antonio, Tex.

[73] Assignee: Baker Oil Tools, Inc., Orange, Calif.

[21] Appl. No.: 546,937

[22] Filed: Oct. 31, 1983

[51] Int. Cl.[3] ..... E21B 37/00

[52] U.S. Cl. ..... 166/173; 166/175

[58] Field of Search ..... 24/274 WB, 279, 20 EE, 24/284, 285; 166/241, 173, 175

[56] References Cited

U.S. PATENT DOCUMENTS

| | | | |
|---|---|---|---|
| 519,312 | 5/1894 | Arthur | 24/279 |
| 2,787,039 | 4/1957 | Krasberg | 24/279 |
| 4,422,504 | 12/1983 | Moore | 166/241 |
| 4,442,154 | 4/1984 | Förtsch et al. | 24/20 EE |

FOREIGN PATENT DOCUMENTS

| | | | |
|---|---|---|---|
| 2788 | of 1913 | United Kingdom | 24/284 |

*Primary Examiner*—Stephen J. Novosad
*Assistant Examiner*—Michael Goodwin
*Attorney, Agent, or Firm*—Norvell & Associates

[57] ABSTRACT

The invention provides a stop device for installation on a well conduit. The stop device is fabricated from semi-annular elements having one ends thereof pivotally interconnected by a hook and notch connection and the other ends stamped to provide apertured lugs traversed by a clamping device. The effective diameter of the stop is increased by a plurality of peripherally spaced, outwardly projecting notches formed in the top and bottom edges of the semi-annular elements.

2 Claims, 2 Drawing Figures

STOP DEVICE FOR WELL CONDUIT

BACKGROUND OF THE INVENTION

1. Field of the Invention

This invention relates to a stop element which may be detachably secured to a well conduit at any desired axial position and anchored thereon to provide a stop for other tool elements slidably mounted on the conduit.

2. Description of the Prior Art

A large variety of stop devices have heretofore been proposed for mounting on well casings, liners, tubings and similar conduit strings, for engaging and moving other apparatus mounted on such strings through a well bore. Such devices should be capable of detachable securement to the particular conduit in any desired axial position thereon and should provide a sufficiently large radial abutment on such conduit as to insure that no other apparatus slidably mounted on the same conduit can pass over the stop device. Moreover, the stop device should preferably be fabricated from components produced by stamping operations in order to minimize the manufacturing costs thereof.

Conventional stop devices comprising two semi-annular elements interconnected by a hinge pin are commercially available. As will be obvious to those skilled in the art, the fabrication of hinge elements required machining operations so as to provide sufficient accuracy of the hinge apertures so that when the two elements are secured together by hinge pin, they will be in substantial axial alignment. Moreover, while a hinge connection provides relative pivotal movement of the two semi-annular elements of the stop device in a radial plane, it is well recognized that the hinge does not permit any movement of the two semi-annular elements in any plane other than that perpendicular to the axis of the hinge pin. Thus, if the two semi-annular elements are hinged together and are not precisely axially aligned, then when they are disposed in encompassing relationship to a well conduit, the non-hinged or free ends of the two semi-annular elements must be brought together with very substantial force to actually stretch the semi-annular elements into axial alignment with each other and into fully contacting relationship with the well conduit. If a bolt or other similar securing means is employed to effect the connection of the free ends, the bolt will appear to be very tight when this misalignment condition exists when actually very little clamping force is being exerted on the encompassed well conduit.

SUMMARY OF THE INVENTION

The invention provides a stop device for detachable mounting on any form of well conduit comprising two semi-annular elements having two of their ends pivotally interconnected by a tongue and groove connection. Thus, the one end of one element is provided with at least one, and preferably a plurality of axially spaced notches, while the one end of the other semi-annular element is provided with an equal number of generally radially projecting tongues or hooks which respectively engage the notches. This type of connection provides the required relative pivotal movement of the two semi-annular elements to permit encompassing a well conduit, but also permits a modest degree of relative movement in a radial plane of one semi-annular element with respect to the other so that such elements may in all cases, be snugly engaged with the one half of the surface of the encompassed well conduit. Thus, the stop device accommodates itself to the configuration of the well conduit without requiring fabrication of machined hinges, and the entire tightening force applied to a retaining bolt which secures the other ends of the semi-annular elements together can be utilized to effect a clamping action of the two semi-annular elements against the well conduit.

A further feature of the invention lies in the fabrication of the semi-annular elements as a band having a relatively smaller radial thickness than heretofore employed. This band is then notched at spaced intervals around both its top and bottom axial surfaces to in effect provide an increased effective diameter of the band when secured around a well conduit, thus, assuring that no apparatus slidably mounted on the well conduit will pass the band, even though its radial thickness is substantially less than that heretofore employed in the industry.

DESCRIPTION OF THE PREFERRED EMBODIMENT

Figure 1:
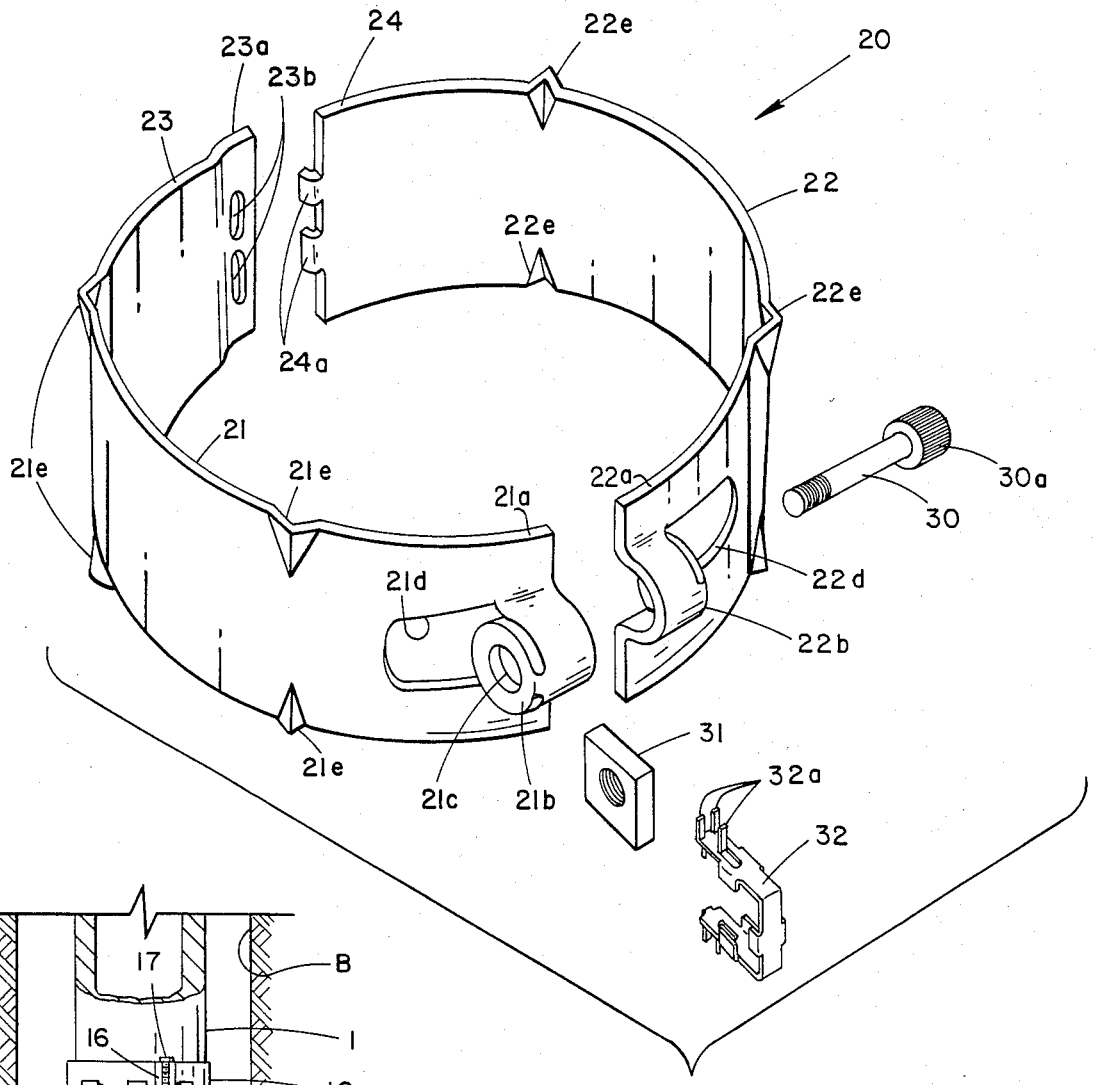
FIG. 1 is an exploded perspective view of a stop device embodying this invention.
Figure 2:
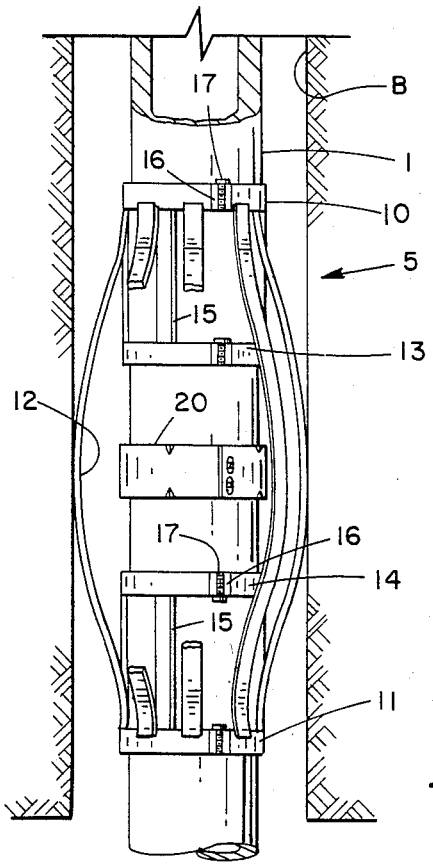
FIG. 2 is a view illustrating the stop device of FIG. 1 assembled to a well conduit to function as a stop for a slidably mounted centralizer apparatus.

Referring to the drawings, a stop device 20 is utilized for securement to a string of well tubing 1 or any other form of well conduit, and is adapted to engage another apparatus, such as a casing centralizer 5, slidably mounted on the tubing string. The device is shown in conjunction with a casing centralizer for illustrative purposes only, it being understood that it is also useful in other relationships, being adapted for engagement with wall scratchers, cementing baskets, and other apparatus that requires slidable mounting on a casing, or similar well conduit, to be moved longitudinally therewith through the well bore B.

The casing centralizer is of conventional construction. As specifically illustrated, it includes upper and lower longitudinally spaced collars 10, 11 slidable on the conduit 1, the collars being interconnected by circumferentially spaced, outwardly bowed leaf spring members 12 welded or otherwise suitably secured thereto. The intermediate portions of the springs engage the wall of the well bore B and tend to center the well casing therein, in a known manner.

Upper and lower stop rings, 13 and 14, are secured in longitudinally spaced relation to the upper and lower collars 10, 11 respectively, as by the use of circumferentially spaced, longitudinally extending rigid bars 15 attached to both the collars and the rings by welding, or in any other suitable manner.

The particular centralizer 5 is of the hinge type, in which collars 10, 11 and the rings 13, 14 are each made in two parts secured to one another by diametrically opposed hinges 16. The hinges on one side of the device may be disconnected as by removing the hinge pin 17 which would then allow the centralizer 5 to be swung to open position and placed laterally around the well conduit 1. Afterwards, the centralizer 5 can be closed, the hinge pin 17 reinserted through the hinge knuckles, all in a known manner, to slidably mount the centralizer on the well conduit 1. To move centralizer 5 longitudinally through the well bore B upon the well conduit 1, the stop device 20 embodying this invention is secured to the conduit 1 between the upper and lower stop rings 13 and 14 and collars 10, 11, so that, irrespective of the direction of movement of the well conduit 1, the centralzier 5 will be moved therewith by engagement of the stop device 20 with either the upper ring 13 or the lower ring 14.

Referring now to FIG. 1, the stop device 20 embodying this invention comprises two semi-annular elements 21 and 22 which are both fabricated in their entirety by stamping operations upon a relatively thin band of steel. The ends 21*a* and 22*a* of the semi-annular bands 21 and 22 are both fabricated in identical fashion to define a generally radially projecting shoulder 21*b* and 22*b* which are then respectively apertured at 21*c* to receive a clamping bolt 30 in generally tangential relationship to the band elements 21 and 22. The stamping of the shoulders 21*b* and 22*b* results in the formation of elongated notches 21*d* and 22*d* respectively in the end portions of the semi-annular bands 21 and 22. The bolt head 30*a* abuts the one apertured shoulder 21*b* while a nut 31 is threaded onto the other end of the bolt 30 and engages the other apertured shoulder 22*b*. For convenience in assembly, a stamped locking clip 32 is provided in surrounding relationship to the nut 31 and has fingers 32*a* which are respectively bent into abutting relationship with the side walls of the slot 21*d* from which the shoulder 21*b* was originally stuck out.

The other ends 23 and 24 repsectively of bands 21 and 22 are fabricated to provide a relatively loose pivotal connection of such ends. Thus, the extreme end portion 23*a* of the band 21 is deformed to lie slightly radially outwardly beyond the perimeter of the adjacent end 24 of the band 22. The outwardly deformed portion 23*a* is provided with a plurality of axially spaced notches 23*b*. The extreme end portion of the adjacent band end 24 is formed with an equal number of generally radially projecting tongues or hooks 24*a* which respectively engage in the notches 23*b*. In this manner, a pivotal connection of the bands 20 and 21 is achieved, permitting the bands to be assembled by such pivotal connection and opened to encompass the well conduit 1 on which the band is to be applied. The bands 21 and 22 are then moved to snugly surround the well conduit 1 and bring the ends 21*a* and 22*a* into as close proximity as permitted by the diameter of the encompassed conduit. Obviously, the internal diameter of the bands 21 and 22 when their ends are in abutment with each other is less than the diameter of the well conduit 1 to be encompassed.

The clamping bolt 30 is then inserted through the aligned apertures 21*c*, 22*c* and the nut 31 is applied to such bolt and the flanges 32*a* of the locking clip 32 are bent to lie adjacent to the inner and outer surfaces of the slot 21*d*, thus securing the nut 31 against rotation. Tightening of the bolt 30 will then draw the two ends 21*a* and 22*a* of the bands 21 and 22 into closer proximity, exerting a clamping action on the well conduit 1.

It should be particularly noted that the axial length of the notches 23*b* provided in the end of band 22 is of greater extent than of the axial length of the tongues or hooks 24*a*, thus, permitting not only relative pivotal movement of the two bands 21 and 22 heretofore described but also some adjustment of such bands in a plane other than a radial plane so that even though the bands may be slightly deformed from a true semi-annular configuration, they will nevertheless be free to be drawn into snug engagement with the respective cylindrical side of the conduit 1 with which they are to be engaged.

Because of the fact that the bands 21 and 22 are fabricated with a radial thickness substantially less than that heretofore employed, it is preferable to provide a plurality of integrally formed, outwardly extending notches or projections 21*e* and 22*e* in both the top and the bottom end walls of the bands 21 and 22 to insure that the band will not permit the apparatus for which it is to function as a stop to slide over its perimeter thus, in effect, the notches 21*e* and 22*e* effectively increase the retaining diameter of the band 20 without requiring an increase in the wall thickness of the semi-annular band elements 21 and 22.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A stop device adapted to be mounted on a conduit to be disposed in a subterranean well comprising: a pair of semi-annular metallic band elements; notch means on the one end of one said semi-annular band element; hook means on the one end of the other said semi-annular band element and cooperable with said notch means to pivotally secure together the respective one ends of said semi-annular band elements, whereby the other ends of said semi-annular band elements may be moved away from each other to encompass a well conduit and moved toward each other to exert a clamping force on the encompassed well conduit; and adjustable means for urging said other ends of said semi-annular band elements toward each other, thereby clamping said stop device to the well conduit; said one end of said one semi-annular band element containing said notch means being radially outwardly offset from the remainder of said one semi-annular band element, and said hook means is generally radially disposed relative to the remainder of said other semi-annular band element.

2. The stop device of claim 1 wherein said notch means comprises a plurality of axially spaced slots, and said hook means comprise a plurality of axially spaced, generally radial tongues integrally formed on the end of said other annular band element and respectively insertable in said slots.

* * * * *